US007229481B2

(12) United States Patent
Clark et al.

(10) Patent No.: US 7,229,481 B2
(45) Date of Patent: Jun. 12, 2007

(54) DIESEL FUEL COMPOSITIONS

(75) Inventors: Richard Hugh Clark, Chester (GB); Christopher Morley, Chester (GB); Paul Anthony Stevenson, Chester (GB)

(73) Assignee: Shell Oil Company, Houston, TX (US)

( * ) Notice: Subject to any disclaimer, the term of this patent is extended or adjusted under 35 U.S.C. 154(b) by 221 days.

(21) Appl. No.: 10/706,594

(22) Filed: Nov. 12, 2003

(65) Prior Publication Data

US 2004/0194367 A1 Oct. 7, 2004

(30) Foreign Application Priority Data

Nov. 13, 2002 (EP) ..... 02257805

(51) Int. Cl.
*C10L 1/32* (2006.01)

(52) U.S. Cl. ..... 44/301

(58) Field of Classification Search ..... 44/301
See application file for complete search history.

(56) References Cited

U.S. PATENT DOCUMENTS

| | | | | |
|---|---|---|---|---|
| 4,125,566 | A | 11/1978 | Trin Dinh et al. | 250/676 R |
| 4,208,190 | A | 6/1980 | Malec | 44/53 |
| 4,478,955 | A | 10/1984 | Pesa et al. | 518/713 |
| 4,647,288 | A | 3/1987 | Dillon | |
| 5,268,008 | A | 12/1993 | Kanne | |
| 5,308,365 | A | 5/1994 | Kesling, Jr. et al. | |
| 5,378,348 | A | 1/1995 | Davis et al. | 208/27 |
| 5,484,462 | A | 1/1996 | Herbstman | 44/334 |
| 5,490,864 | A | 2/1996 | Herbstman et al. | 44/379 |
| 5,766,274 | A | 6/1998 | Wittenbrink et al. | 44/436 |
| 5,888,376 | A | 3/1999 | Wittenbrink et al. | 208/59 |
| 6,162,956 | A | 12/2000 | Berlowitz et al. | 585/14 |
| 6,204,426 | B1 | 3/2001 | Miller et al. | 585/739 |
| 6,210,559 | B1 | 4/2001 | Cook et al. | 208/15 |
| 2001/0004971 | A1 | 6/2001 | Wittenbrink et al. | 208/15 |

FOREIGN PATENT DOCUMENTS

| | | | |
|---|---|---|---|
| EP | 0147240 | A2 | 7/1985 |
| EP | 0147240 | B1 | 7/1985 |
| EP | 0147873 | A1 | 7/1985 |
| EP | 0482253 | A1 | 4/1992 |
| EP | 0557561 | A1 | 9/1993 |
| EP | 0583836 | A1 | 2/1994 |
| EP | 0613938 | A1 | 9/1994 |
| EP | 1101813 | A1 | 5/2001 |
| EP | 1152049 | A2 | 11/2001 |
| GB | 960493 | | 6/1964 |
| GB | 2077289 | A | 12/1981 |
| GB | 2308383 | A | 6/1997 |
| GB | 2368594 | | 5/2002 |
| WO | WO 94/17160 | | 8/1994 |
| WO | WO 95/33805 | | 12/1995 |
| WO | WO 97/14768 | | 4/1997 |
| WO | WO 97/14769 | | 4/1997 |
| WO | WO 98/01516 | | 1/1998 |
| WO | WO 98/42808 | | 10/1998 |
| WO | WO 99/13028 | | 3/1999 |
| WO | WO 99/13031 | | 3/1999 |
| WO | WO9921943 | | 5/1999 |
| WO | WO 99/63025 | | 12/1999 |
| WO | WO 00/11116 | | 3/2000 |
| WO | WO 00/11117 | | 3/2000 |
| WO | WO 00/20534 | | 4/2000 |
| WO | WO 00/20535 | | 4/2000 |
| WO | WO 01/83406 | A2 | 11/2001 |
| WO | WO 01/83641 | A2 | 11/2001 |
| WO | WO 01/83647 | A2 | 11/2001 |
| WO | WO 01/83648 | A2 | 11/2001 |

OTHER PUBLICATIONS

"The Performance of Diesel Fuel Manufactured by Shell's GtL Technology in the Latest Technology Vehicles," by R.H. Clark, I.G. Virrels, C. Maillard, M. Schmidt, Proceedings of 3rd Int. Colloquium, "Fuels," Tech. Akad. Esslingen, Ostfilder, Germany, 2001.

"NOx Reduction with EGR in a Diesel Engine Using Emulsified Fuel," by Yasufumi Yoshimoto, Minoru Tsukahara, Ziye Li and Hiroshi Sano, SAE Paper 982490, 1998.

"Low Emission Water Blend Diesel Fuel," by Daniel T. Daly et al., Symposium on New Chemistry of Fuel Additives, 219th National Meeting, American Chemical Society, 2000.

"AQUAZOLE™: An Original Emulsified Water-Diesel Fuel for Heavy-Duty Applications," by Frederic Barnaud, Pierre Schmelzie and Philippe Schulz, SAE Paper 2000-01-1861, 2000.

"The Lubricity of Diesel Fuels," by Danping Wei and H. A. Spikes, Wear, 111 (1986) pp. 217-235.

"The Performance of Diesel Fuel Manufactured by the Shell Middle Distillate Synthesis Process," by R.H. Clark and J.F. Unsworth, Proceedings of 2nd Int. Colloquium, "Fuels," Tech. Akad. Esslingen, Ostfildern, Germany, 1999.

"The Shell Middle Distillate Synthesis Process," M.J. van der Burgt, J. van Klinken, S.T. Sie (paper delivered at the 5th Synfuels Worldwide Symposium, Washington DC, Nov. 1985).

James H. Gary and Glenn E. Handwerk, "2.6 Automotive Diesel Fuels", Petroleum Refining Technology and Economics Fourth Edition, 2001, pp. 17-18, Marcel Dekker, Inc., New York, NY, USA.

Gas to Liquids: Shell Middle Distillate Synthesis Process and Products (a Shell brochure Aug. 2002).

Paul Norton et al., "Emissions from Trucks Using Fischer-Tropsch Diesel Fuel," SAE Technical Paper Series 982526, Oct. 22, 1998.

*Primary Examiner*—Edward J. Cain

(57) ABSTRACT

A water-in-fuel emulsion composition containing a Fischer-Tropsch derived fuel and water, and its use in a compression ignition engine is provided. Emissions, for example of $NO_x$, black smoke and/or particulate matter, are lower as compared to conventional fuels but without lengthening the ignition delay and reducing the cetane number. This is achieved without the need for, or at reduced levels of, ignition improving additives, and without engine modifications.

28 Claims, No Drawings

DIESEL FUEL COMPOSITIONS

FIELD OF THE INVENTION

The present invention relates to diesel fuel compositions, particularly aqueous diesel fuel emulsions.

BACKGROUND OF THE INVENTION

Hydrocarbon-water emulsions have been known for many years and have many uses, including that of fuel-water emulsions.

Such fuel-water emulsions have a number of advantages.

For example, in "*NOx Reduction with EGR in a Diesel Engine Using Emulsified Fuel*", Y. Yoshimito et al., *SAE Paper* 982490, 1998, it is described how from environmental concerns reductions in $NO_x$ and particulate emissions from diesel engines had been mandated in recent years. It states that diesel engines using water-in-gas oil emulsified fuel have shown simultaneous improvements in $NO_x$, smoke and fuel consumption.

In "*Low Emission Water Blend Diesel Fuel*", D. T. Daly et al., *Symposium on New Chemistry of Fuel Additives,* 219th National Meeting, American Chemical Society, 2000, it is described that the addition of water to diesel fuel lowers emissions of particulates by serving as a diluent to the key combustion intermediates, and decreases $NO_x$ by lowering combustion temperatures through its high heat of evaporation.

In "*AQUAZOLE™: An Original Emulsified Water-Diesel Fuel for Heavy-Duty Applications*", Barnaud et al., *SAE Paper* 2000-01-1861, 2000, it is described that the advantages of injecting water into an internal combustion engine included raising viscosity levels, removal of sediment, and reduction of nitrogen oxide emissions by reducing combustion temperature. There is also specific reference to reduction in black smoke and particulates emissions.

WO-A-99/13028 relates to emulsions comprising a Fischer-Tropsch derived liquid hydrocarbon, a non-ionic surfactant and water, and states that such emulsions are easier to prepare and more stable than the corresponding emulsions with petroleum derived hydrocarbons. There is specific reference to such emulsions having better emission characteristics than petroleum derived emulsions. However, WO-A-99/13028 is concerned with emulsions in which water is the continuous phase, i.e. oil-in-water emulsions.

WO-A-99/63025 relates to aqueous fuel compositions which exhibit reduced $NO_x$ and particulate emissions. It describes how the rates at which $NO_x$ are formed is related to the flame temperature during combustion in an engine. It describes how the flame temperature can be reduced by the use of aqueous fuels, i.e. incorporating both water and fuel into an emulsion. However, it indicates that problems that may occur from long-term use of aqueous fuels include precipitate deposition. It is described that water preferably functions as the continuous phase of the emulsion. Example 5 therein refers specifically to the test engine being modified to run a fuel-in-water emulsion. Therefore, although there is reference in said Example 5 to a fuel emulsion in which the diesel fuel was Fischer-Tropsch diesel, it is clearly a fuel-in-water emulsion. It also indicates that a significant barrier to the commercial use of aqueous fuel emulsions is emulsion stability.

As described in "*The performance of Diesel Fuel manufactured by the Shell Middle Distillate Synthesis process*", Clark et al.,*Proceedings of* 2nd *Int. Colloquium, "Fuels"*, Tech, Akad. Esslingen, Ostfildern, Germany, 1999, the diesel cut from the SMDS process has very good cetane quality, low density, plus negligible sulphur and aromatics contents, such properties making it potentially valuable as a diesel fuel with lower emissions than conventional automotive gas oil (AGO). "*The performance of Diesel fuel manufactured by Shell's GtL technology in the latest technology vehicles*", Clark et al., *Proceedings of* 3rd *Int. Colloquium, "Fuels"*, Tech, Akad. Esslingen, Ostfildern, Germany, 2001 describes SMDS diesel product and discusses the emissions benefits.

GB-A-2308383 describes water-in-oil emulsions in middle distillate fuel, particularly diesel fuel. It is directed to the reduction of emissions by the inclusion of an organic nitrate ignition improver.

Therefore, there are emissions advantages in using fuel-water emulsions. However, it is also known that ignition delay or lag is longer and cetane number is lower with emulsions based on conventional fuel than with non-emulsified conventional fuel.

SUMMARY OF THE INVENTION

Accordingly, in one embodiment there is provided a water-in-fuel emulsion composition comprising a Fischer-Tropsch derived fuel and water, wherein said water-in-fuel emulsion composition have an ignition delay of equal or less than the equivalent cetane number of 40.

Further, in another embodiment there is provided a water-in-fuel emulsion composition comprising a Fischer-Tropsch derived fuel and water, wherein said water-in-fuel emulsion composition have an ignition delay of about 3 or less measured using an AVL/LEF 5312 engine under operating condition as described in Tables 2 and 3.

Yet, in further embodiments reducing ignition delay and/or emissions of $NO_x$ and/or black smoke and/or particulate matter in a compression ignition engine in the presence of a water-in-fuel emulsion composition comprising a Fischer-Tropsch produced fuel and water are provided.

In another embodiment, a method of operating a compression ignition engine is provided comprising including in said engine a water-in-fuel emulsion composition which comprises a Fischer-Tropsch derived fuel and water.

A process for producing such water-in-fuel emulsion is also provided.

DETAILED DESCRIPTION OF THE INVENTION

It has now been found that when using water-in-fuel emulsions (where fuel is the continuous phase), in which the fuel component comprises a Fischer-Tropsch diesel product, certain engine performance advantages are achieved. Such performance advantages are in particular that emissions, for example of $NO_x$, black smoke and/or particulate matter (PM), are lower as compared to conventional fuels but without lengthening the ignition delay and reducing the cetane number. This is achieved without the need for, or at reduced levels of, ignition improving additives, and without engine modifications. Such emulsions having these characteristics have not been disclosed.

The present invention relates to aqueous diesel fuel emulsions in which the fuel comprises a Fischer-Tropsch derived fuel, their preparation and their use in compression ignition engines. In accordance with the present invention there is provided a water-in-fuel emulsion composition comprising a Fischer-Tropsch derived fuel and water, wherein the ignition quality of said emulsion falls within the range specified in ASTM D975 and/or EN590.

EN590 is the European Standard for automotive diesel fuels. Generally applicable requirements and test methods of the EN590 European Standard is provided in the table below. The terms "% (m/m)" and "% (V/V)" are used to represent respectively the mass fraction and the volume fraction. ASTM D975-03 is the current United States standard for automotive diesel fuels.

The minimum cetane number in the specification according to EN590 is 51. The minimum cetane number in the specification according to ASTM D975-03 is 40 as measured by ASTM D613-03B. Where ASTM D613-03B is not available D4787 can also be used. However, preferably the cetane number for automobile is about 44 or greater. In some region of the U.S.A., a higher ignition quality fuel is preferred having a cetane number of about 50 or greater.

By "ignition quality" is meant ignition delay and/or cetane number. The method for determining "ignition delay" is provided in the emulsion preparation section below. The value of ignition delay may vary depending on the engine used for testing so the ignition delay equivalent of the cetane number is determined by empirical formula using the same engine as described below using the Fisher-Tropsch derived fuel and standard fuel and various blends of the fuels.

In one embodiment of the invention, the water-in-fuel emulsion composition comprising a Fischer-Tropsch derived fuel and water have an ignition delay of about 3 or less, preferably about 3.1 or less, measured using an AVL/LEF 5312 engine under operating condition as described in Tables 2 and 3 using test procedure as described in Table 4 below.

The composition preferably contains no ignition improving additive.

A fuel comprising a Fischer-Tropsch derived fuel, their preparation and their use in compression ignition engines is provided.

Although in accordance with the present invention it is preferred that the fuel used is a Fischer-Tropsch derived fuel, the present invention contemplates a blend of said Fischer-Tropsch derived fuel with a conventional base fuel. Such blends would contain the Fischer-Tropsch derived fuel and conventional base fuel in such proportions that when water is added the required ignition quality still is achieved. The amount of the Fischer-Tropsch derived fuel used may be from 0.5 to 100% w/w of the blend, preferably from 1 to 60% w/w, more preferably from 5 to 50% w/w, most preferably from 10 to 30% w/w.

Such a conventional base fuel may typically comprise liquid hydrocarbon middle distillate fuel oil(s), for instance petroleum derived gas oils. Such fuels will typically have boiling points within the usual diesel range of 150 to 400° C., depending on grade and use. It will typically have a density from 0.75 to 0.9 g/cm$^3$, preferably from 0.8 to 0.86 g/cm$^3$, at 15° C. (e.g. ASTM D4502 or IP 365) and a cetane number (ASTM D613) of from 35 to 80, more preferably from 40 to 75. It will typically have an initial boiling point in the range 150 to 230° C. and a final boiling point in the range 290 to 400° C. Its kinematic viscosity at 40° C. (ASTM D445) might suitably be from 1.5 to 4.5 mm$^2$/s.

In accordance with the present invention there is also provided the use in a compression ignition engine of a water-in-fuel emulsion composition for the purpose of reducing the ignition delay in the engine, said composition comprising a Fischer-Tropsch derived fuel and water.

In accordance with the present invention there is further provided the use in a compression ignition engine of a water-in-fuel emulsion composition for the purpose of reducing the emission of $NO_x$, said composition comprising a Fischer-Tropsch derived fuel and water.

In accordance with the present invention there is further provided the use in a compression ignition engine of a water-in-fuel emulsion composition for the purpose of reducing the emission of black smoke and/or particulate matter, said composition comprising a Fischer-Tropsch derived fuel and water.

In this specification, "reduce" and "reducing" mean as compared to one or more of the use of a Fischer-Tropsch derived fuel, the use of a conventional, that is, petroleum derived, fuel, the use of a water-in-fuel emulsion composition based on just such a conventional fuel, and the use of a fuel-in-water emulsion composition based on such a conventional fuel or on such a Fischer-Tropsch derived fuel, as appropriate.

In accordance with the present invention there is yet further provided the use in a water-in-fuel emulsion composition of a Fischer-Tropsch derived fuel so as to reduce, in a compression ignition engine in which it is used, emissions of $NO_x$, black smoke and/or particulate matter, whilst maintaining the ignition quality of the emulsion.

By "maintaining the ignition quality" is meant maintaining the ignition delay and the cetane number within the ranges specified in EN590 and/or ASTM 975-03.

In accordance with the present invention there is still further provided a method of reducing emissions of $NO_x$ and/or black smoke and/or particulate matter in a compression ignition engine, as compared to that when using a conventional fuel having a specification in accordance with EN590 and/or ASTM D975, but without reducing the ignition quality, which comprises replacing said fuel in said engine by a water-in-fuel emulsion composition which comprises a Fischer-Tropsch derived fuel and water.

The present invention also contemplates reducing emissions by replacing in a compression ignition engine a petroleum derived hydrocarbon fuel, a Fischer-Tropsch derived fuel, a water-in-fuel emulsion composition based on just such a conventional fuel, or a fuel-in-water emulsion composition based on such a conventional fuel or on such a Fischer-Tropsch derived fuel.

In accordance with the present invention there is yet further provided a method of operating a compression ignition engine comprising including in said engine a water-in-fuel emulsion composition which comprises a Fischer-Tropsch derived fuel and water.

The Fischer-Tropsch derived fuel should be suitable for use as a diesel fuel. Its components (or the majority, for instance 95% w/w or greater, thereof) should therefore have boiling points within the typical diesel fuel ("gas oil") range, i.e. from 150 to 400° C. or from 170 to 370° C. It will suitably have a 90% v/v distillation temperature (T90) of from 300 to 370° C.

By "Fischer-Tropsch derived" is meant that the fuel (gas oil) is, or derives from, or produced from, a synthesis product of a Fischer-Tropsch condensation process directly and/or by further treatments. The Fischer-Tropsch reaction converts carbon monoxide and hydrogen into longer chain, usually paraffinic, hydrocarbons:

$$n(CO+2H_2)=(—CH_2—)_{n+n}H_2O+\text{heat},$$

in the presence of an appropriate catalyst and typically at elevated temperatures (e.g. 125 to 300° C., preferably 175 to 250° C.) and/or pressures (e.g. 500 to 10000 kPa (5 to 100 bar), preferably 1200 to 5000 kPa (12 to 50 bar)). Hydrogen: carbon monoxide ratios other than 2:1 may be employed if desired.

The carbon monoxide and hydrogen may themselves be derived from organic or inorganic, natural or synthetic sources, typically either from natural gas or from organically derived methane.

A gas oil product may be obtained directly from the Fischer-Tropsch reaction, or indirectly for instance by fractionation of a Fischer-Tropsch synthesis product or from a hydrotreated Fischer-Tropsch synthesis product. Hydrotreatment can involve hydrocracking to adjust the boiling range (see, e.g. GB-B-2077289 and EP-A-0147873) and/or hydroisomerisation which can improve cold flow properties by increasing the proportion of branched paraffins. EP-A-0583836 describes a two-step hydrotreatment process in which a Fischer-Tropsch synthesis product is firstly subjected to hydroconversion under conditions such that it undergoes substantially no isomerisation or hydrocracking (this hydrogenates the olefinic and oxygen-containing components), and then at least part of the resultant product is hydroconverted under conditions such that hydrocracking and isomerisation occur to yield a substantially paraffinic hydrocarbon fuel. The desired gas oil fraction(s) may subsequently be isolated for instance by distillation.

Other post-synthesis treatments, such as polymerisation, alkylation, distillation, cracking-decarboxylation, isomerisation and hydroreforming, may be employed to modify the properties of Fischer-Tropsch condensation products, as described for instance in U.S. Pat. No. 4,125,566 and U.S. Pat. No. 4,478,955, which disclosures are hereby incorporated by reference.

Typical catalysts for the Fischer-Tropsch synthesis of paraffinic hydrocarbons comprise, as the catalytically active component, a metal from Group VIII of the periodic table, in particular ruthenium, iron, cobalt or nickel. Suitable such catalysts are described for instance in EP-A-0583836 (pages 3 and 4).

An example of a Fischer-Tropsch based process is the SMDS (Shell Middle Distillate Synthesis) described in "The Shell Middle Distillate Synthesis Process", van der Burgt et al (paper delivered at the 5$^{th}$ Synfuels Worldwide Symposium, Washington D.C., November 1985; see also the November 1989 publication of the same title from Shell International Petroleum Company Ltd, London, UK). This process (also sometimes referred to as the Shell™ "Gas-to-Liquids" or "GTL" technology) produces middle distillate range products by conversion of a natural gas (primarily methane) derived synthesis gas into a heavy long-chain hydrocarbon (paraffin) wax which can then be hydroconverted and fractionated to produce liquid transport fuels such as the gas oils useable in diesel fuel compositions. A version of the SMDS process, utilising a fixed-bed reactor for the catalytic conversion step, is currently in use in Bintulu, Malaysia and its products have been blended with petroleum derived gas oils in commercially available automotive fuels.

Gas oils prepared by the SMDS process are commercially available from the Royal Dutch/Shell Group of Companies. Further examples of Fischer-Tropsch derived gas oils are described in EP-A-0583836, EP-A-1101813, WO-A-97/14768, WO-A-97/14769, WO-A-00/20534, WO-A-00/20535, WO-A-00/11116, WO-A-00/11117, WO-A-01/83406, WO-A-01/83641, WO-A-01/83647, WO-A-01/83648, U.S. Pat. No. 5,766,274, U.S. Pat. No. 5,378,348, U.S. Pat. No. 5,888,376 and U.S. Pat. No. 6,204,426.

Suitably, in accordance with the present invention, the Fischer-Tropsch derived gas oil will consist of at least 70% w/w, preferably at least 80% w/w, more preferably at least 90% w/w, most preferably at least 95% w/w, of paraffinic components, preferably iso- and linear paraffins. The weight ratio of iso-paraffins to normal paraffins will suitably be greater than 0.3 and may be up to 12; suitably it is from 2 to 6. The actual value for this ratio will be determined, in part, by the hydroconversion process used to prepare the gas oil from the Fischer-Tropsch synthesis product. Some cyclic paraffins may also be present.

By virtue of the Fischer-Tropsch process, a Fischer-Tropsch derived gas oil has essentially no, or undetectable levels of, sulphur and nitrogen. Compounds containing these heteroatoms tend to act as poisons for Fischer-Tropsch catalysts and are therefore removed from the synthesis gas feed. Further, the process as usually operated produces no or virtually no aromatic components. The aromatics content of a Fischer-Tropsch gas oil, as determined for instance by ASTM D4629, will typically be below 1% w/w, preferably below 0.5% w/w and more preferably below 0.1% w/w.

The Fischer-Tropsch derived gas oil used in the present invention will typically have a density from 0.76 to 0.79 g/cm$^3$ at 15° C.; a cetane number (ASTM D613) greater than 70, suitably from 74 to 85; a kinematic viscosity (IP71/ASTM D445) from 2 to 4.5, preferably 2.5 to 4.0, more preferably from 2.9 to 3.7, mm$^2$/s at 40° C.; and a sulphur content (ASTM D2622) of 5 ppmw (parts per million by weight) or less, preferably of 2 ppmw or less.

Preferably it is a product prepared by a Fischer-Tropsch methane condensation reaction using a hydrogen/carbon monoxide ratio of less than 2.5, preferably less than 1.75, more preferably from 0.4 to 1.5, and ideally using a cobalt containing catalyst. Suitably it will have been obtained from a hydrocracked Fischer-Tropsch synthesis product (for instance as described in GB-B-2077289 and/or EP-A-0147873), or more preferably a product from a two-stage hydroconversion process such as that described in EP-A-0583836 (see above). In the latter case, preferred features of the hydroconversion process may be as disclosed at pages 4 to 6, and in the examples, of EP-A-0583836.

In said water-in-fuel emulsion composition of the present invention, the water is present preferably in an amount of at least 1%, preferably 1 to 50%, more preferably 5 to 35%, most preferably 10 to 35%, by weight of the emulsion composition.

Said water-in-fuel emulsion composition preferably contains one or more emulsifiers, such as ionic or non-ionic surfactants. Suitable surfactants are as described below. Such emulsifier(s) is/are preferably present in the amount of at least 1%, more preferably 1 to 10%, still more preferably 1 to 7%, by weight of the emulsion composition.

The present invention is particularly applicable where the fuel composition is used or intended to be used in a direct injection or an indirect injection diesel engine, for example of the rotary pump, electronic unit injector or common rail type. It may be of particular value for rotary pump engines, and in other diesel engines which rely on mechanical actuation of the fuel injectors and/or a low pressure pilot injection system.

Diesel fuel-water emulsions have been used in order to improve the emissions performance of diesel fuels. It is also known to use emulsions to reduce the emissions levels of low quality diesel fuel, e.g. marine or industrial diesel fuels, to acceptable levels.

However, a drawback of diesel fuel-water emulsions is that water causes a considerable lowering of the cetane number (i.e. ignition quality) of the fuel as compared to that of diesel fuel.

It has now been found that as Fischer-Tropsch (e.g. SMDS) derived fuels have an intrinsically high cetane number, greater than 75, an acceptable ignition quality of a fuel-water emulsion can be achieved by use of a Fischer-Tropsch derived fuel in such an emulsion.

Furthermore, because of such high cetane numbers of Fischer-Tropsch derived fuels, emulsions containing them can in fact contain higher levels of water than are customarily used in fuel-water emulsions, so providing fuels with very low, or even zero, particulate emissions.

The SMDS reaction products suitably have boiling points within the typical diesel fuel range (between 150 and 370° C.), a density of between 0.76 and 0.79 g/cm$^3$ at 15° C., a cetane number greater than 72.7 (typically between 75 and 82), a sulphur content of less than 5 ppmw, a viscosity between 2.9 and 3.7 mm$^2$/s at 40° C. and an aromatics content of no greater than 1% w/w.

The emulsion composition of the present invention may, if required, contain one or more additives as described below.

Detergent-containing diesel fuel additives are known and commercially available, for instance from Infineum (e.g. F7661 and F7685) and Octel (e.g. OMA 4130D). Such additives may also be added to diesel fuels at relatively low levels (their "standard" treat rates providing typically less than 100 ppmw active matter detergent in the overall additivated fuel composition) intended merely to reduce or slow the build up of engine deposits.

Examples of detergents suitable for use in fuel additives for the present purpose include polyolefin substituted succinimides or succinamides of polyamines, for instance polyisobutylene succinimides or polyisobutylene amine succinamides, aliphatic amines, Mannich bases or amines and polyolefin (e.g. polyisobutylene) maleic anhydrides. Succinimide dispersant additives are described for example in GB-A-960493, EP-A-0147240, EP-A-0482253, EP-A-0613938, EP-A-0557561 and WO-A-98/42808. Particularly preferred are polyolefin substituted succinimides such as polyisobutylene succinimides.

The additive may contain other components in addition to the detergent. Examples are lubricity enhancers; anti-foaming agents (e.g. the polyether-modified polysiloxanes commercially available as TEGOPREN™ 5851 and Q 25907 (ex. Dow Corning), SAG™ TP-325 (ex. OSi), or RHODORSIL™ (ex. Rhone Poulenc)); ignition improvers (cetane improvers) (e.g. 2-ethylhexyl nitrate (EHN), cyclohexyl nitrate, di-tert-butyl peroxide and those disclosed in U.S. Pat. No. 4,208,190 at column 2, line 27 to column 3, line 21); anti-rust agents (e.g. that sold commercially by Rhein Chemie, Mannheim, Germany as "RC 4801", a propane-1, 2-diol semi-ester of tetrapropenyl succinic acid, or polyhydric alcohol esters of a succinic acid derivative, the succinic acid derivative having on at least one of its alpha-carbon atoms an unsubstituted or substituted aliphatic hydrocarbon group containing from 20 to 500 carbon atoms, e.g. the pentaerythritol diester of polyisobutylene-substituted succinic acid); corrosion inhibitors; reodorants; anti-wear additives; anti-oxidants (e.g. phenolics such as 2,6-di-tert-butylphenol, or phenylenediamines such as N,N'-di-sec-butyl-p-phenylenediamine); and metal deactivators.

It is particularly preferred that the additive include a lubricity enhancer, especially when the fuel composition has a low (e.g. 500 ppmw or less) sulphur content. In the additivated fuel composition, the lubricity enhancer is conveniently present at a concentration between 50 and 1000 ppmw, preferably between 100 and 1000 ppmw. Suitable commercially available lubricity enhancers include EC 832 and PARADYNE™ 655 (ex. Infineum), HITEC™ E580 (ex. Ethyl Corporation), VEKTRON™ 6010 (ex. Infineum) and amide-based additives such as those available from the Lubrizol Chemical Company, for instance LZ 539 C. Other lubricity enhancers are described in the patent literature, in particular in connection with their use in low sulfur content diesel fuels, for example in:

- the paper by Danping Wei and H. A. Spikes, "*The Lubricity of Diesel Fuels*", Wear, III (1986) 217–235;
- WO-A-95/33805—cold flow improvers to enhance lubricity of low sulphur fuels;
- WO-A-94/17160—certain esters of a carboxylic acid and an alcohol wherein the acid has from 2 to 50 carbon atoms and the alcohol has 1 or more carbon atoms, particularly glycerol monooleate and di-isodecyl adipate, as fuel additives for wear reduction in a diesel engine injection system;
- U.S. Pat. No. 5,484,462—mentions dimerised linoleic acid as a commercially available lubricity agent for low sulfur diesel fuel (column 1, line 38), and itself provides aminoalkylmorpholines as fuel lubricity improvers;
- U.S. Pat. No. 5,490,864—certain dithiophosphoric diester-dialcohols as anti-wear lubricity additives for low sulfur diesel fuels; and
- WO-A-98/01516—certain alkyl aromatic compounds having at least one carboxyl group attached to their aromatic nuclei, to confer anti-wear lubricity effects particularly in low sulfur diesel fuels.

It is also preferred that the additive contain an anti-foaming agent, more preferably in combination with an anti-rust agent and/or a corrosion inhibitor and/or a lubricity additive.

Unless otherwise stated, the (active matter) concentration of each such additional component in the additivated fuel composition is preferably up to 10000 ppmw, more preferably in the range from 5 to 1000 ppmw, advantageously from 75 to 300 ppmw, such as from 95 to 150 ppmw.

The (active matter) concentrations of components (with the exception of the ignition improver) will each preferably be in the range from 0 to 20 ppmw, more preferably from 0 to 10 ppmw. The (active matter) concentration of any ignition improver present will preferably be between 0 and 600 ppmw, more preferably between 0 and 500 ppmw, conveniently from 300 to 500 ppmw.

The additive will typically contain the detergent, optionally together with other components as described above, and a diesel fuel-compatible diluent, which may be a carrier oil (e.g. a mineral oil), a polyether, which may be capped or uncapped, a non-polar solvent such as toluene, xylene, white spirits and those sold by member companies of the Royal Dutch/Shell Group under the trade mark "SHELLSOL", and/or a polar solvent such as an ester and, in particular, an alcohol, e.g. hexanol, 2-ethylhexanol, decanol, isotridecanol and alcohol mixtures such as those sold by member companies of the Royal Dutch/Shell Group under the trade mark "LINEVOL", especially LINEVOL™ 79 alcohol which is a mixture of $C_{7-9}$ primary alcohols, or the $C_{12-14}$ alcohol mixture commercially available from Sidobre Sinnova, France under the trade mark "SIPOL".

The additive may be suitable for use in heavy and/or light duty diesel engines.

The Fischer-Tropsch fuel may be used in combination with any other fuel suitable for use in a diesel engine. It will typically have an initial distillation temperature of about 160° C. and a final distillation temperature of between 290 and 360° C., depending on its grade and use. Vegetable oils may also be used as diesel fuels per se or in blends with hydrocarbon fuels.

The base fuel may itself be additivated (additive-containing) or unadditivated (additive-free). If additivated, e.g. at the refinery, it will contain minor amounts of one or more additives selected for example from anti-static agents, pipeline drag reducers, flow improvers (e.g. ethylene/vinyl acetate copolymers or acrylate/maleic anhydride copolymers) and wax anti-settling agents (e.g. those commercially available under the trade marks "PARAFLOW" (e.g. PARAFLOW™ 450, ex. Infineum), "OCTEL" (e.g. OCTEL™ W 5000, ex. Octel) and "DODIFLOW" (e.g. DODIFLOW™ 3958, ex. Hoechst).

In accordance with the present invention there is also provided a process for the preparation of a water-in-fuel emulsion composition which process comprises admixing a Fischer-Tropsch derived fuel with water, wherein the water is present preferably in an amount of at least 1%, more preferably 1 to 50%, still more preferably 5 to 35%, yet more preferably 10 to 35%, by weight of the emulsion composition.

Said process preferably includes admixing with said Fischer-Tropsch derived fuel and water an emulsifier such as a surfactant. Said surfactant may be an ionic or non-ionic surfactant, preferably the latter. Such a non-ionic surfactant is preferably selected from alkoxylates, such as alcohol ethoxylates and alkylphenol ethoxylates; carboxylic acid esters, such as glycerol esters and polyoxyethylene esters; anhydrosorbitol esters, such as ethoxylated anhydrosorbitol esters; natural ethoxylated fats, oils and waxes; glycol esters of fatty acids; alkyl polyglycosides; carboxylic amides, such as diethanolamine condensates and monoalkanolamine condensates; fatty acid glucamides; polyalkylene oxide block copolymers and poly(oxyethylene-co-oxypropylene) non-ionic surfactants. Alternatively, a mixture of surfactants can be used. It is preferred that the HLB (hydrophile-lipophile balance) value of the surfactant or mixture of surfactants is in the range 3 to 9, more preferably 3 to 6. In the case of a mixture of surfactants, the HLB of the mixture is dependent on the proportions of the surfactants in the mixture and their respective HLB values, and is preferably in the ranges given above.

Particularly suitable non-ionic surfactants include SPAN 85 (sorbitan trioleate, ex. Uniqema, HLB 1.8), SPAN 65 (sorbitan tristearate, ex. Uniqema, HLB 2.1), KESSCO PGMS PURE (propylene glycol monostearate, ex. Stepan, HLB 3.4), KESSCO GMS 63F (glycerol monostearate, ex. Stepan, HLB 3.8), SPAN 80 (sorbitan monooleate, ex. Uniqema, HLB 4.3), SPAN 60 (sorbitan monostearate, ex. Uniqema, HLB 4.7), BRIJ 52 (polyoxyethylene (2) cetyl ether, ex. Uniqema, HLB 5.3) and SPAN 20 (sorbitan monolaurate, ex. Uniqema, HLB 8.6). Further suitable non-ionic surfactants, which may be used in suitable proportions in mixtures having the preferred HLB values, include ALDO MSA (glycerol monostearate, ex. Lonza, HLB 11), RENEX 36 (polyoxyethylene (6) tridecyl ether, ex. Uniqema, HLB 11.4), BRIJ 56 (polyoxyethylene (10) cetyl ether, ex. Uniqema, HLB 12.9), TWEEN 21 (polyoxyethylene (4) sorbitan monolaurate, ex. Uniqema, HLB 13.3), RENEX 30 (polyoxyethylene (12) tridecyl ether, ex. Uniqema, HLB 14.5) and BRIJ 58 (polyoxyethylene (20) cetyl ether, ex. Uniqema, HLB 15.7).

The present invention will now be described with reference to the following examples.

Method of Preparing Fischer-Tropsch (SMDS) Water-in-fuel Emulsions

The emulsion fuels used to generate the emissions and combustion data referred to in this specification were prepared in 1-litre batches as follows:

TABLE 1

| Sample name | SMDS diesel | SPAN 80* | TWEEN 21** | Water*** |
|---|---|---|---|---|
| 0% water | 705 g | 22.5 g | 22.5 g | None |
| 10% water | 651 g | 23.2 g | 23.2 g | 77.5 g |
| 20% water | 592 g | 24.0 g | 24.0 g | 160.0 g |
| 30% water | 528 g | 24.7 g | 24.7 g | 247.5 g |
| 35% water | 494 g | 25.0 g | 25.0 g | 294.0 g |

*Sorbitan monooleate
**Polyoxyethylenesorbitan monolaurate
***Laboratory grade from a Millipore RO/MilliQ⁺ water purification system Emulsion Preparation Method The required amount of SMDS diesel, non-ionic surfactants SPAN 80 (HLB 4.3) and TWEEN 21 (HLB 13.3) were added to a 2.5 litre Pyrex glass beaker, tall form. The beaker was set under a Silverson High Shear laboratory mixer, Model L2R, fitted with standard mixing head and emulsor screen. The contents were mixed for 30 seconds to disperse the emulsifiers. Mixing was continued at full speed whilst adding gradually, over a period of approximately 1 minute, the predetermined quantity of water. Mixing was continued until 5 minutes had elapsed since the first addition of water. Weight measurements were carried out using an electronic top-pan balance (Oertling GC32).

The emulsion fuels prepared by this method remained stable as milky-white homogeneous mixtures for at least 48 hours before significant phase separation was observed. Engine testing was carried out within 48 hours of preparation.

The usual method for measuring the ignition quality of diesel fuels (Cetane Number—ASTM D613) is inappropriate in respect of diesel-water emulsions. However, in the AVL/LEF 5312 engine used for emissions measurements it was possible to measure ignition delay, of which cetane number is effectively a measurement.

The AVL/LEF 5312 engine is a diesel research engine manufactured by AVL/LEF, based on a Volvo D12 unit. The fuel injection system employs ECU-controlled unit injection. An intake boost compressor is fitted, and the engine can be operated with or without supercharging. The engine was set up to Euro II emissions standard. The engine specification is shown in Table 2:

TABLE 2

| | |
|---|---|
| Type | Single cylinder, water cooled, 4 stroke, OHC 4 V, DI diesel engine |
| Swept volume | 2022 $cm^3$ |
| Bore | 131 mm |
| Stroke | 150 mm |
| Nominal compression ratio | 17.8:1 |
| Maximum speed | 3000 rpm |
| Maximum charge pressure | 300 kPa absolute |
| Maximum power (boosted) | 48 kW @ 1800 rpm |
| Maximum torque (boosted) | 311 Nm @ 1200 rpm |
| Maximum cylinder pressure | 18 MPa |

Emissions analysis equipment comprised a Horiba EXSA1500EGR analyser, an AVL 439 opacity meter and an AVL 415 smoke meter. A Richard Oliver partial flow particulates tunnel provided dilution for particulate filter measurements.

The fuelling system was designed to allow rapid switching between a variety of sources of fuel and a procedure was adopted which allowed smoke tests to be routinely performed on only 1 litre of test fuel. The procedure allowed each test fuel to be bracketed by tests with a reference fuel, thus providing a convenient way to normalise results and compare the performance of different fuels while accounting for day-to-day variation in engine response.

The operating conditions for the AVL/LEF engine were as set out in Table 3:

TABLE 3

| | |
|---|---|
| Torque set point, Nm | 130 |
| Speed set point, rpm | 1200 |
| Coolant set point, ° C. | 80 |
| Air intake temperature, ° C. | 35 |
| Air intake pressure, kPa | 140 |
| Exhaust pressure, kPa | 120 |
| Injection timing, ° crank angle | 1 BTDC |

The test procedure was as set out in Table 4:

TABLE 4

| Step | Duration | Fuel |
|---|---|---|
| 1. Warm up | 20 minutes | Base |
| 2. Stabilise at test condition | 12 minutes | Base |
| 3. Data collection | 8 × 30 seconds then average | Base |
| 4. Flush | 1 minute | Test fuel 1 |
| 5. Stabilise at test condition | 1 minute | Test fuel 1 |
| 6. Data collection | 8 × 30 seconds then average | Test fuel 1 |
| 7. Flush | 1 minute | Base |
| 8. Stabilise at test condition | 6.5 minutes | Base |
| 9. Data collection | 8 × 30 seconds then average | Base |
| 10. Loop to Step 4 for remaining test fuels | | |

The SMDS fuel was a high quality synthetic fuel derived from natural gas by the Fischer-Tropsch process, the properties of which were as set out in Table 5:

TABLE 5

| | |
|---|---|
| Density @ 15° C. (IP365/ASTM D4502) | 0.776 g/cm$^3$ |
| Distillation (IP23/ASTM D86): | |
| Initial boiling point | 183° C. |
| T50 | 275° C. |
| T90 | 340° C. |
| Final boiling point | 359° C. |
| Cetane number (ASTM D613) | 81 |
| Kinematic viscosity @ 40° C. (IP71/ASTM D445) | 3.10 mm$^2$/s |
| Cloud point (IP219) | ° C. |
| Sulphur (ASTM D2622) | <2 mg/kg |
| Aromatic content (IP391 Mod) | <0.1% m |
| Flash point | 73° C. |

Emissions data for black smoke (filter smoke number and opacity) and nitrogen oxides ($NO_x$) for the emulsion fuels listed in Table 1 above are set out in Table 6:

TABLE 6

| wt % water | AVL smoke number | Opacity, % | $NO_x$, ppm |
|---|---|---|---|
| 0 | 1.59 | 6.55 | 543 |
| 10 | 0.42 | 1.46 | 537 |
| 20 | 0.07 | 0.25 | 484 |
| 30 | 0.02 | 0.07 | 429 |
| 35 | 0.01 | 0.04 | 379 |

From Table 6, it can be seen that, for an emulsion containing 35% water, the smoke number and opacity, which are both measures of black smoke and/or particulates, are both virtually zero. Moreover, $NO_x$ levels are much lower as compared to those for non-emulsified SMDS fuel.

Expressed in an alternative way, as shown in Table 7:

TABLE 7

| | % reduction in emissions relative to SMDS | | |
|---|---|---|---|
| wt % water | AVL smoke number | Opacity | $No_x$ |
| 10 | −74% | −78% | −1.1% |
| 20 | −96% | −96% | −11% |
| 30 | −99% | −99% | −21% |
| 35 | −99+% | −99+% | −30% |

From Table 7, it can be seen that for an emulsion containing, for example, 35% water, the reduction in smoke number and opacity as compared to that for non-emulsified SMDS fuel is over 99%, and that for $NO_x$ is 30%.

Ignition delay was computed using an AVL 670 Indimaster, a multiple channel indicating system specifically designed for use with compression ignition engines. In this application, it is the parameter defined as the delay between start of injection and start of combustion that is of interest.

The start of combustion is determined from the differential heat release curve. This is derived from the cylinder pressure using the first law of thermodynamics. Due to the fuel injection, the heat release curve dips into the negative range before its steep rise. The subsequent zero pass is taken to be start of combustion.

In electronic unit injector systems, the start of injection is defined by the injector solenoid closing point. The solenoid is triggered by a signal from the electronic control unit (ECU). In this application, the ECU signal is recorded as a trace that is displayed on the Indimaster. Due to the lag between when the signal is measured and when the pulse actually triggers the solenoid, an offset occurs between apparent and actual start of injection. The offset is a constant time and therefore increases in terms of degrees crank angle with rising engine speed. At the standard test engine speed of 1200 rpm, it has been established that the actual start of injection occurs 10.2 degrees after the recorded start of injection. A simple formula has been built into the Indimaster to correct the ignition delay (in degrees of crank angle) which is:

$$\text{Ignition delay} = \text{Start of combustion} - (10.2 + \text{injection start})$$

Table 8 shows ignition delays for a series of emulsions of SMDS and water, stabilised by an emulsifier additive. For comparison purposes, the delay measured under identical conditions for a fuel of known cetane number has been included.

From Table 8, it can be seen that, as the proportion of water in the water-in-fuel emulsion composition is increased, the ignition delay also increases, i.e. the cetane number decreases. However, it can also be seen that, even when the water-in-fuel emulsion composition contains 35% water, the ignition delay is lower than that of Swedish Class 1 diesel, of which the ignition delay is 2.6 (and the cetane number is 54). Therefore, a water-in-fuel emulsion containing 35% water not only exhibits virtually zero smoke number and opacity, but also a superior ignition delay compared to that of Swedish Class 1 diesel, the latter being regarded as a "clean" diesel.

TABLE 8

| wt % water | Ignition delay (degrees of crank angle) | Cetane number |
|---|---|---|
| 0 | 1.7 | 81* |
| 10 | 1.8 | |
| 20 | 2.05 | |
| 30 | 2.15 | |
| 35 | 2.4 | |
| Swedish Class I diesel | 2.6 | 54 |

N.B. A decreasing ignition delay means an increasing cetane number.
*Measuring fuels with cetane number > 72 such a Fischer-Tropsch Diesel Cetane number measurements made using the recognised procedure of ASTM D613-03B, can typically only cover the range from 22 to 73. This is because "secondary reference" fuels used in the engine measurement procedure covers that particular range, T -fuel high reference typically 73–75 and U-fuel low reference, typically 20 to 22.

However the range of cetane measurements in ASTM D613-03 can be extended by using the primary reference materials, that is n-cetane with a minimum purity of 99.0% as the high reference with a designated cetane number of 100, and heptamethylnonane (2,2,3,3,6,8,8-heptamethylnonane) with a minimum purity of 98% as the low cetane reference with a designated cetane number of 15.

Using the primary reference fuels in the ASTM D613-03 will this allow direct measurement of the high cetanes found for Fischer Tropsch fuels, e.g. 81 as in Table 5 and Table 8.

The properties of a typical Swedish Class 1 diesel fuel are set out in Table 9:

TABLE 9

| | |
|---|---|
| Density @ 15° C. (IP365/ASTM D4502) | 0.8150 g/cm$^3$ |
| Distillation (IP23/ASTM D86): | |
| Initial boiling point | 186.0° C. |
| T50 | 235.0° C. |
| T90 | 264.0° C. |
| Final boiling point | 290.5° C. |
| Cetane number (ASTM D613) | 54.5 |
| Kinematic viscosity @ 40° C. (IP71/ASTM D445) | 2.030 mm$^2$/s |
| Cloud point (IP219) | −32° C. |
| CFPP (IP309) | −37° C. |
| Sulphur (ASTM D2622) | <5 mg/kg |
| Aromatic content (IP391 Mod) | 4.4% m |
| Flash point | 74° C. |

Ignition Delay to Equivalent Cetane Number

Ignition quality is measured by two different methods, using (1) "Ignition Delay" as measured in the AVL/LEF 5312 engine or (2) Using Cetane number as determined in cetane engine descibed in ASTM D613-03B.

By blending various proportions of two hydrocarbon fuels (i.e. non-emulsion fuels), for example a refinery diesel of cetane number 40 and a Fischer Tropsch diesel of cetane number 81, then one can make parallel determinations in both engines. The results will be a set of cetane numbers in the range 40 to 81 and their equivalent ignition delay values as measured in the AVL/LEF 5312 engine.

An X-Y plot of these two measurements performed on an identical set of fuels will give a line, which will allow one to translate an ignition delay from the AVL/LEF 5312 engine into an equivalent cetane number.

For example, if one found an emulsion which gave an ignition delay of 2.6 (degrees of crank angle) in the AVL/LEF 5312 engine, reading off the graph plot line would indicate that its ignition quality is equivalent to a fuel of 54 cetane number.

We claim:

1. A water-in-fuel emulsion composition comprising a Fischer-Tropsch derived fuel and water, wherein said water-in-fuel emulsion composition has an ignition delay of equal or less than the equivalent cetane number of 40.

2. The composition of claim 1 which contains no ignition improving additive.

3. The composition of claim 1 wherein the water-in-fuel emulsion composition comprises an emulsifier.

4. The composition of claim 1 wherein the water-in-fuel emulsion composition has an ignition delay of equal or less than the equivalent cetane number of about 44.

5. The composition of claim 4 wherein the water-in-fuel emulsion composition has an ignition delay of equal or less than the equivalent cetane number of about 50.

6. A water-in-fuel emulsion composition comprising a Fischer-Tropsch derived fuel and water, wherein said water-in-fuel emulsion composition has an ignition delay of about 3 degrees of crank angle or less measured using an AVL/LEF 5312 engine wherein the operating conditions comprise a torque set point of 130 Nm, a speed set point of 1200 rpm, a coolant temperature set point of 80° C., an air intake temperature of 35° C., an air intake pressure of 140 kPa, an exhaust pressure of 120 kPa, and injection timing set at 1° of crank angle before top dead center (BTCD).

7. The composition of claim 6 wherein the water-in-fuel emulsion composition has an ignition delay of about 3.1 degrees of crank angle or less.

8. The composition of claim 6 which contains no ignition improving additive.

9. The composition of claim 7 which contains no ignition improving. additive.

10. The composition of claim 6 wherein the water-in-fuel emulsion composition comprises an emulsifier.

11. The composition of claim 7 wherein the water-in-fuel emulsion composition comprises an emulsifier.

12. A method of reducing ignition delay in a compression ignition engine comprising operating the compression ignition engine in the presence of a water-in-fuel emulsion composition, said composition comprising a Fischer-Tropsch produced fuel and water.

13. A method of reducing the emission of NOx from a compression ignition engine comprising operating the compression ignition engine in the presence of a water-in-fuel emulsion composition, said composition comprising a Fischer-Tropsch produced fuel and water.

14. A method of reducing the emission of black smoke and/or particulate matter from a compression ignition engine comprising operating the compression ignition engine in the presence of a water-in-fuel emulsion composition, said composition comprising a Fischer-Tropsch derived fuel and water.

15. The method of claim 12 wherein the water-in-fuel emulsion composition contains no ignition-improving additive.

16. The method of claim 13 wherein the water-in-fuel emulsion composition contains no ignition-improving additive.

17. The method of claim 14 wherein the water-in-fuel emulsion composition contains no ignition-improving additive.

18. A method of reducing emissions of $NO_X$ and/or black smoke and/or particulate matter in a compression ignition engine, as compared to that when using a conventional fuel having a specification in accordance with ASTM D975, but without reducing the ignition quality, which comprises replacing said fuel in said engine by a water-in-fuel emulsion composition which comprises a Fischer-Tropsch derived fuel and water.

19. A method of operating a compression ignition engine comprising including in said engine a water-in-fuel emulsion composition which comprises a Fischer-Tropsch derived fuel and water.

20. The method of claim 19 wherein the water-in-fuel emulsion composition has an ignition delay of about 3 degrees of crank angle or less measured using an AVL/LEF 5312 engine wherein the operating conditions comprise a torque set point of 130 Nm, a speed set point of 1200 rpm, a coolant temperature set point of 80° C., an air intake temperature of 35° C., an air intake pressure of 140 kPa, an exhaust pressure of 120 kPa, and injection timing set at 1° of crank angle BTCD.

21. The method of claim 19 wherein the water-in-fuel emulsion composition has an ignition delay of equal or less than the equivalent cetane number of 40.

22. The method of claim 20 wherein the water-in-fuel emulsion composition has an ignition delay of about 3.1 degrees of crank an angle or less.

23. The method of claim 21 wherein the water-in-fuel emulsion composition has an ignition delay of equal or less than the equivalent cetane number of about 44.

24. The method of claim 20 which contains no ignition improving additive.

25. The method of claim 21 which contains no ignition improving additive.

26. The method of claim 22 which contains no ignition improving additive.

27. The method of claim 23 which contains no ignition improving additive.

28. A process for the preparation of a water-in-fuel emulsion composition which process comprises admixing a Fischer-Tropsch derived fuel with water.

* * * * *